US012168866B2

(12) United States Patent
Frazao

(10) Patent No.: US 12,168,866 B2
(45) Date of Patent: Dec. 17, 2024

(54) BEAM COUPLER OPERATING AS A SEISMIC BRAKE, SEISMIC ENERGY DISSIPATION DEVICE AND SEISMIC DAMAGE CONTROL DEVICE

(71) Applicant: QUAKETEK INC., Saint-Laurent (CA)

(72) Inventor: Richard Frazao, Dollard-des-Ormeaux (CA)

(73) Assignee: QUAKETEK INC., Saint-Laurent (CA)

( * ) Notice: Subject to any disclaimer, the term of this patent is extended or adjusted under 35 U.S.C. 154(b) by 0 days.

(21) Appl. No.: 17/865,094

(22) Filed: Jul. 14, 2022

(65) Prior Publication Data

US 2022/0364351 A1 Nov. 17, 2022

Related U.S. Application Data

(62) Division of application No. 16/900,122, filed on Jun. 12, 2020, now Pat. No. 11,396,746.

(60) Provisional application No. 62/861,676, filed on Jun. 14, 2019.

(51) Int. Cl.
*E04B 1/24* (2006.01)
*E04H 9/02* (2006.01)

(52) U.S. Cl.
CPC ..... *E04B 1/2403* (2013.01); *E04H 9/0237* (2020.05); *E04B 2001/2406* (2013.01); *E04B 2001/2415* (2013.01)

(58) Field of Classification Search
CPC ..... E04B 1/2403; E04B 2001/2406; E04B 2001/2415; E04B 2001/2439; E04H 9/0237; F04B 2001/2496
USPC ..... 52/167.3
See application file for complete search history.

(56) References Cited

U.S. PATENT DOCUMENTS 1,945,005 A * 1/1934 Vacher ..... F16B 39/26 411/149
1,963,535 A * 6/1934 Trotter ..... F16B 39/24 411/149
3,009,176 A * 11/1961 Knocke ..... B23P 19/08 29/520
3,631,910 A * 1/1972 Crowther ..... F16B 39/24 411/149
3,828,885 A * 8/1974 Eissinger ..... B60R 21/00 180/69.21

(Continued)

*Primary Examiner* — Paola Agudelo
*Assistant Examiner* — Adam G Barlow
(74) *Attorney, Agent, or Firm* — Benoit & Cote Inc.; Charles-Andre Caron; Mathieu Audet

(57) ABSTRACT

A beam coupler adapted to couple two beams mounted side by side. One coupler comprises a central plate mounted to the first beam, comprising two central-plate side faces in the coupling orientation; and a longitudinal oblong hole providing a passage connecting the two side faces. The coupler also comprises a pair of side plates mounted to the second beam, each comprising an interior face to neighbor the central plate; an exterior face; and a circular side-plate hole providing a passage connecting the interior face with the exterior face. The coupler further comprises compression means applying an inward preload over the plates, comprising a body extending between the exterior faces through the circular and oblong holes. The oblong holes allow displacement of the body of the compression means therein in the longitudinal direction upon a displacement of the plates resulting from a deflection of the beams.

20 Claims, 13 Drawing Sheets

(56) References Cited

U.S. PATENT DOCUMENTS 3,856,242 A * 12/1974 Cook ..... F16F 15/06 248/548
3,867,003 A * 2/1975 Morton ..... H01L 23/4006 257/688
4,441,289 A * 4/1984 Ikuo ..... E04H 9/0237 52/657
5,112,178 A * 5/1992 Overhues ..... F16B 39/24 267/161
5,845,438 A * 12/1998 Haskell ..... E04H 9/0237 52/167.3
6,516,583 B1 * 2/2003 Houghton ..... E04B 1/24 52/638
7,462,007 B2 * 12/2008 Sullivan ..... F16B 39/24 411/231
7,581,913 B2 * 9/2009 Ordonio, Jr. ..... F16B 37/14 411/533
7,647,734 B2 * 1/2010 Sarkisian ..... E04H 9/0237 248/220.21
7,703,244 B2 * 4/2010 Suzuki ..... E04B 1/24 403/217
7,712,266 B2 * 5/2010 Sarkisian ..... E04H 9/0237 52/573.1
7,784,226 B2 * 8/2010 Ichikawa ..... E04H 9/0237 52/693
7,857,566 B2 * 12/2010 Sullivan ..... F16B 39/24 29/446
8,807,307 B2 * 8/2014 Choi ..... E04H 9/0237 248/562
9,260,860 B2 * 2/2016 Mualla ..... E04B 1/98
9,316,014 B2 * 4/2016 Chou ..... E04G 23/0218
9,580,924 B1 * 2/2017 Taylor ..... E04H 9/028
9,689,173 B2 * 6/2017 Wu ..... E04H 9/0237
10,106,979 B2 * 10/2018 Lee ..... E04B 1/98
10,323,430 B1 * 6/2019 Pall ..... E04H 9/024
10,408,250 B2 * 9/2019 Webb ..... F16B 31/02
10,431,945 B1 * 10/2019 Baechtle ..... H02J 9/06
10,563,418 B2 * 2/2020 Pall ..... E04H 9/024
2012/0038091 A1 * 2/2012 Tagawa ..... E04H 9/0237 267/136
2012/0260585 A1 * 10/2012 Mualla ..... E04B 1/98 52/167.1
2014/0174002 A1 * 6/2014 Mualla ..... E04B 1/98 52/167.1
2015/0135611 A1 * 5/2015 Beard ..... E04H 9/024 52/167.3
2015/0184413 A1 * 7/2015 Pryor ..... E04C 3/04 52/167.3
2015/0284971 A1 * 10/2015 Ichikawa ..... F16F 15/022 267/140.13
2019/0186165 A1 * 6/2019 Pall ..... E04B 1/92
2019/0383053 A1 * 12/2019 Pall ..... E04H 9/024

* cited by examiner

BEAM COUPLER OPERATING AS A SEISMIC BRAKE, SEISMIC ENERGY DISSIPATION DEVICE AND SEISMIC DAMAGE CONTROL DEVICE

CROSS-REFERENCE TO RELATED APPLICATION

This application is a divisional application of U.S. patent application Ser. No. 16/900,122 filed Jun. 12, 2022, which claims priority from U.S. provisional patent application 62/861,676 filed Jun. 14, 2019, the specifications of which are hereby incorporated herein by reference in their entireties.

BACKGROUND

(A) Field

The subject matter disclosed generally relates to improvements to energy dissipation dampers, friction couplers and friction coupler assemblies used to dissipate seismic energy and control seismic damage in building structures. More particularly, the subject matter disclosed relates to couplers and dampers used in coupling beams of reinforced concrete, precast concrete or steel building structures.

(b) Related Prior Art

Friction damping has been widely used in the construction industry since the 1980s. The friction damping is effective for seismic control of buildings, i.e., making the buildings more resistant to forces from earthquakes. For instance, known designs of friction damping technologies are described in Canadian patent no. 1,150,474 and U.S. Pat. No. 4,409,765. Such friction damping technologies are typically installed in the bracings of the structure of the building and operate by converting seismic energy from earthquakes into friction/heat. However, there are still configurations and structures for which the known friction damping solutions are not well conceived.

There is therefore a need for improvement in the field, and solutions for particular configurations of structures for which the known friction couplers are ill-adapted.

SUMMARY

According to an embodiment, there is provided a beam coupler to be mounted to a first beam element and to a second beam element mounted side by side, the beam coupler thereby adapted to couple the first beam element and the second beam element, wherein the first beam element and the second beam element are both in a longitudinal orientation, a coupling orientation is defined connecting the first beam to the second beam, the beam coupler comprising: a central plate to be mounted to the first beam element, the central plate comprising: two central-plate side faces in the coupling orientation; and a central-plate hole providing a passage connecting the two central-plate side faces; a pair of side plates to be mounted to the second beam element, each one of the side plates comprising: an interior face neighboring one of the two central-plate side faces; an exterior face; and a side-plate hole providing a passage connecting the interior face with the exterior face; and compression means applying an inward preload over the central plate and the side plates, the compression means comprising: a body extending through the central-plate hole and the side-plate holes, wherein at least one of a) the central-plate hole and b) the side-plate hole has an oblong shape, thereby defining an oblong hole, and wherein the oblong hole allows displacement of the body of the compression means therein upon displacement of the central plate and the side plates relative to each other resulting from a deflection of the beam elements.

According to an aspect, at least one of a) the central-plate hole and b) the side-plate hole has a circular shape.

According to an aspect, a first number of circular holes are present per plate, a second number of oblong holes are present per plate, and wherein the first number is greater than the second number.

According to an aspect, a number of oblong holes is present per plate that is at least two (2), and wherein the oblong holes are parallel to each other.

According to an aspect, the compression means comprises disk springs.

According to an aspect, the beam coupler further comprises friction pads.

According to an aspect, the oblong hole extends in the longitudinal orientation.

According to an aspect, the beam coupler further comprises compression plates to be mounted exterior to the exterior face of each of the side plates.

According to an aspect, the central plate and the side plates each comprise a mounting flange to be mounted to the beam elements.

According to an aspect, the beam coupler comprises mounting flanges to be mounted to the beam elements, and wherein the central plate and the side plates are mounted pivotally to the mounting flanges.

According to an aspect, one of the central plate and the side plates comprises a gusset.

According to an embodiment, there is provided a beam coupling assembly to be mounted to a first beam element and to a second beam element each extending in a longitudinal orientation which defines a coupling orientation toward each other while being perpendicular to the longitudinal orientation, the beam coupling assembly comprising: a first beam coupler adapted to couple the first beam element to the second beam element, the first beam coupler comprising a first-plate set comprising a plate to be mounted to the first beam element and a second-plate set comprising a plate to be mounted to the second beam element, wherein the plates of the first-plate set and of the second-plate set are mounted together to allow relative displacement therebetween; and a second beam coupler adapted to couple the first beam element to the second beam element, the second beam coupler comprising a third-plate set comprising a plate to be mounted to the first beam element and a fourth-plate set comprising a plate to be mounted to the second beam element, wherein the plates of the third-plate set and of the fourth-plate set are mounted together to allow relative displacement therebetween.

According to an aspect, each one of the first-plate set, the second-plate set, the third-plate set and the fourth-plate set comprises at least one plate.

According to an aspect, the second-plate set comprises an additional plate in comparison with the first-plate set.

According to an aspect, one of the first-plate set and of the second-plate set comprises longitudinal oblong holes providing passage through said plates.

According to an aspect, the first beam coupler and the second beam coupler each have one of the first-plate set and of the second-plate set comprising an oblong hole providing passage through said plates, wherein the oblong holes extending in non-parallel orientations relative to each other.

According to an aspect, the first beam coupler comprises: a first exterior face and a second exterior face; and compression means adapted to apply an inward preload over the first beam coupler, comprising: a body adapted to extend between the first exterior face and the second exterior face through the plates of the first set and of the second plate set.

According to an aspect, the compression means comprises disk springs mounted exterior of one of the first exterior face and of the second exterior face.

According to an aspect, the first beam coupler and the second beam coupler are adapted to be mounted in series, whereby the first beam coupler is adapted to be mounted at a first longitudinal distance greater than zero (0) from the second beam coupler.

According to an embodiment, there is provided a beam coupler for coupling a first beam element and to a second beam element, wherein the first beam element and the second beam element are parallel to each other in a longitudinal orientation, the beam coupler comprising: plates for alternate mounting to the first beam element and the second beam element, wherein one of the plates is mounted to the first beam element and a neighboring one of the plates is mounted to the second beam element, further wherein at least one of the plates comprises oblong holes; and compression means applying an inward preload over the plates, the compression means comprising a body extending at least through the oblong holes, wherein the oblong hole allows displacement of the body of the compression means therein upon displacement of the plates relative to each other resulting from a deflection of the first beam element and the second beam element while maintaining parallelism between the first beam element and the second beam element.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1B:
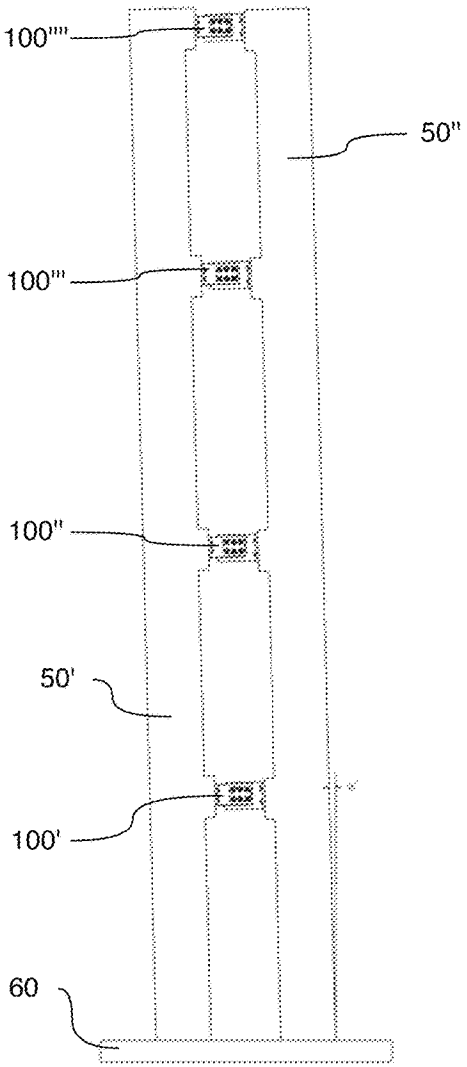
FIGS. 1A and 1B are side elevation views of a beam coupling comprising a pair of beam elements anchored to a common structure with beam coupler dampers joining the beam elements in accordance with an embodiment, respective under no deflection and under deflection.

The realizations will now be described more fully hereinafter with reference to the accompanying figures, in which realizations are illustrated. The foregoing may, however, be embodied in many different forms and should not be construed as limited to the illustrated realizations set forth herein.

With respect to the present description, references to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values and of values herein or on the drawings are not intended to be limiting, referring instead individually to any and all values falling within the range, unless otherwise indicated herein, and each separate value within such a range is incorporated into the specification as if it were individually recited herein. The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described realizations. The use of any and all examples, or exemplary language ("e.g.," "such as," or the like) provided herein, is intended merely to better illuminate the exemplary realizations and does not pose a limitation on the scope of the realizations. No language in the specification should be construed as indicating any unclaimed element as essential to the practice of the realizations.

In the following description, it is understood that terms such as "first", "second", "top", "bottom", "above", "below", and the like, are words of convenience and are not to be construed as limiting terms.

The terms "top", "up", "upper", "bottom", "lower", "down", "vertical", "horizontal", "interior" and "exterior", as the terms "longitudinal", "inward" and "aside" and the like are intended to be construed in their normal meaning in relation with normal installation of the product, with understanding the orientation of the structures on which are mounted the beam coupler dampers with determine the local coordinated according to which these terms be used.

The terms "group", "set" and alike are intended to be construed in relation with ensemble and sub-ensemble of elements, preferably of elements of the same type unless otherwise stated or clear from the context.

Further, the terms "coupled», or "coupling" as used herein can have several different meanings depending in the context in which these terms are used. For example, the terms "coupled", or "coupling" can have a mechanical connotation. For example, as used herein, the terms "coupled", or "coupling" can indicate that two elements or devices are directly connected to one another or connected to one another through one or more intermediate elements or devices via a mechanical element depending on the particular context.

One should further note that references numbers with apostrophes (') are to intent to refer to particular components while the same reference numbers without apostrophes refer either to a typical component with the specific reference or to an ensemble of two or more components with the reference, based on the reference being associated with a singular term or a plural term.

In realizations, there are disclosed beam couplers for a building structure.

Figure 1A:
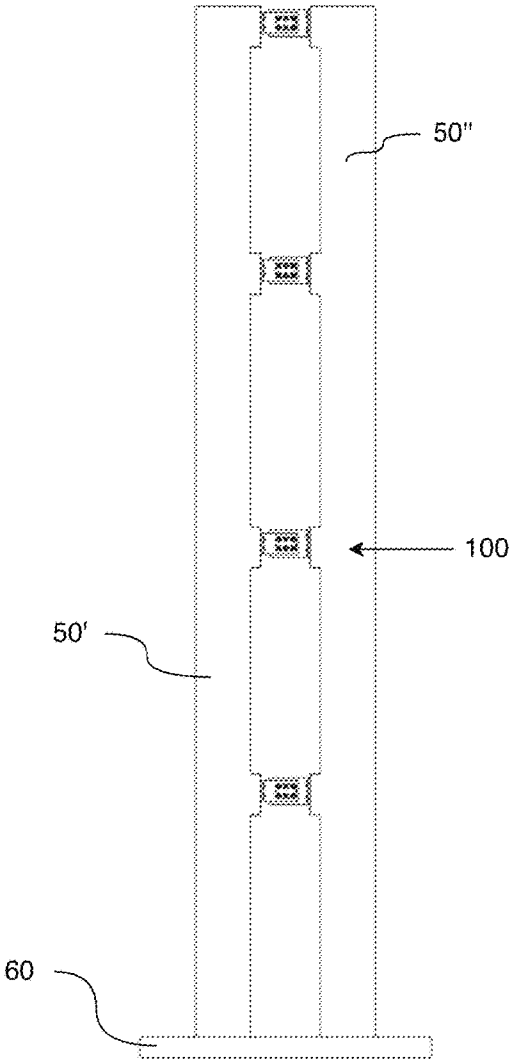

Referring now to the drawings, and more particularly to FIGS. 1A and 1B, the illustrated beam coupling comprises a pair of vertical structural elements, namely structural beam elements 50', 50" that are anchored, a.k.a. pinned, flexible or rigidly connected to a common structure or foundation 60, for instance a floor structure, a beam or any other structural element and are further coupled to each other through a series of beam couplers 100, namely coupler 100', coupler 100", coupler 100'" and coupler 100'". That configuration results in the beam elements 50', 50" following the lateral deflection of each other under seismic lateral actions due to the presence of floor diaphragms.

Each beam coupler 100 replaces a reinforced concrete, precast concrete or steel coupling beam. The beam coupler 100 of a beam coupling is mounted on a first extremity to a first one of the beam elements 50', 50" and on a second extremity to a second one of the beam elements 50', 50". The beam couplers 100 of a beam coupling are mounted to extend inwardly, toward the coupled beam elements 50', 50", therefore coupling the beam elements 50', 50".

According to a realization, a plurality of beam couplers 100 are mounted along the length or height of the beam elements 50', 50" (depending on orientation of the beam elements 50', 50"), coupling the structural beam elements 50', 50" at different elevations from their base. According to a realization, the beam couplers 100 are mounted with a distance being defined based on the characteristics of the beam elements 50', 50", requirements based on location of the structure, architectural possibilities and the damping characteristics of the beam couplers 100.

Referring particularly to FIG. 1B, the structural beam elements 50', 50" are under deflection (the deflection being out of scale for illustration purpose), with the beam couplers 100', 100" and 100'" (i.e., the first, second, third, etc. beam couplers) operating to maintain the coupling between the beam elements 50', 50" without breakage. The beam couplers 100 provide the advantage of maintaining parallelism between the structural beam elements 50', 50" under all degrees of allowed deflection.

Figure 2A:
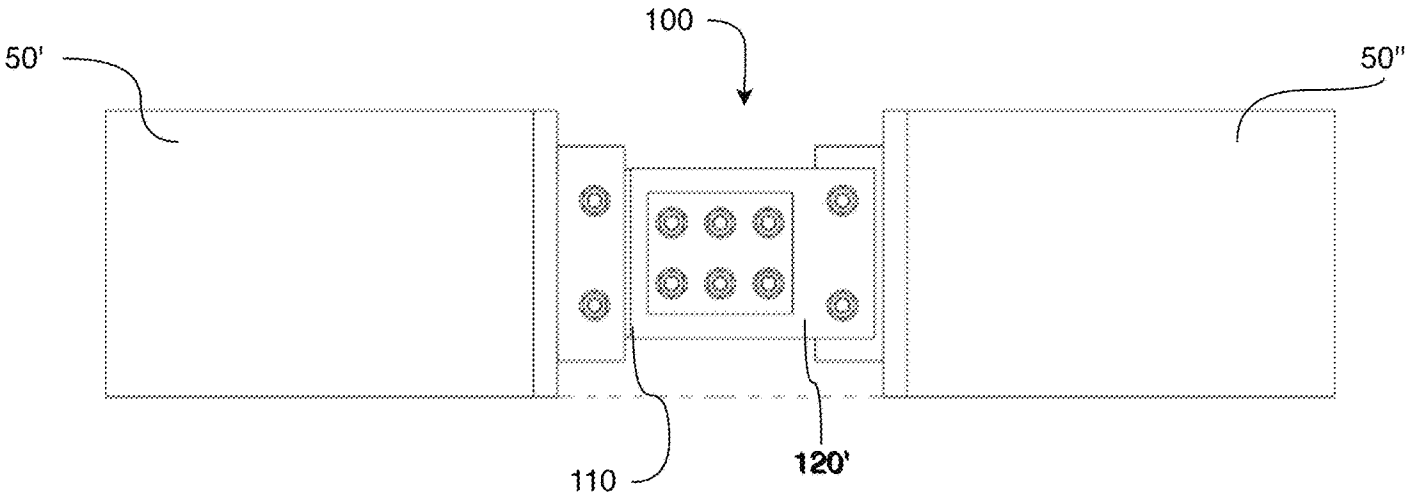
FIGS. 2A and 2B are close-up side elevations views of one of the beam coupler dampers of FIGS. 1A and 1B mounted to the beam elements, respectively with the beam elements undergoing no deflection and the beam elements undergoing deflection, and without compression means on FIG. 2B.
Figure 2B:
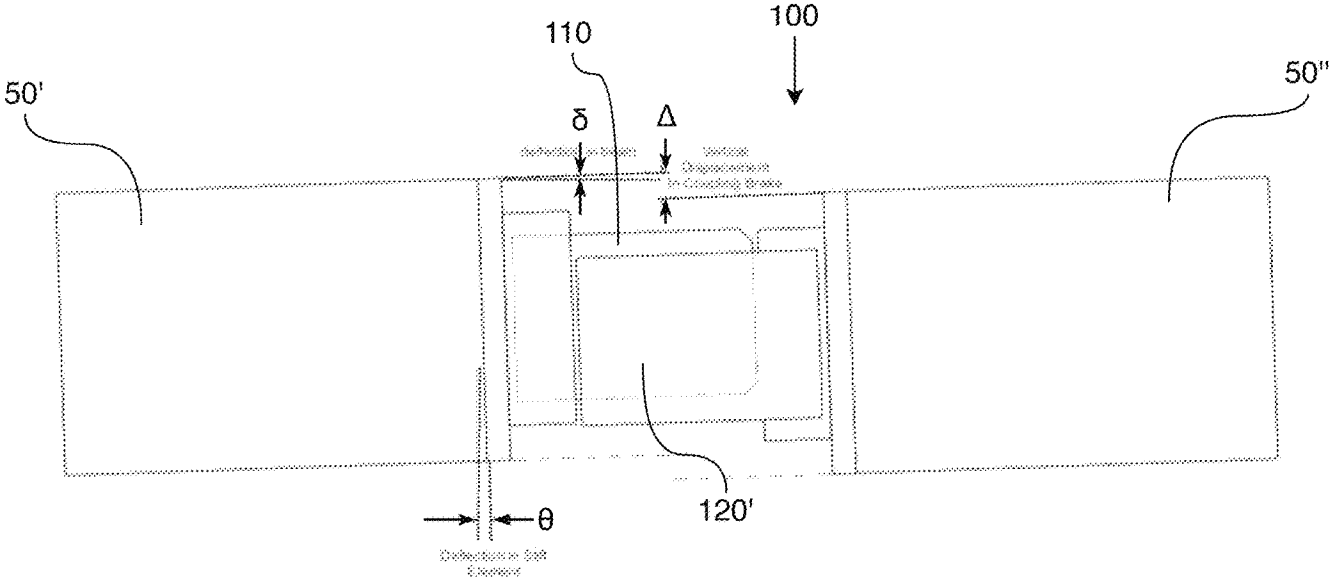

Referring additionally to FIGS. 2A and 2B, the close-up views respectively depict the beam coupler 100 coupling the beam elements 50', 50" when the beam elements 50', 50" undergo no deflection and when the beam elements 50', 50" undergo deflection.

As shown on FIG. 2A, the beam coupler 100 comprises a central plate 110 and side plates 120, with only the front side plate 120' visible depicted thereon. The drawing depicts the central plate 110 and the front side plate 120' longitudinally centered relative to each other, wherein longitudinal refers to the orientation of the beam elements 50', 50" (i.e., the longitudinal orientation, see axes on drawing page featuring FIGS. 6 and 7 for reference).

On FIG. 2B, the beam coupler 100 (without the bolts depicted on FIG. 2A) operates when the beam elements 50', 50" undergo deflection. The drawing depicts the central plate 110 and the front side plate 120 displaced relative to each other. Since the angles of the beam elements 50', 50" have changed (see FIG. 1A depicting out of scale deflection of the structural beam elements), the beam elements 50', 50" acts as an inner arch surface and the outer beam elements 50" acting as an outer arch surface maintained parallel to the inner arch surface where the beam elements 50', 50" are coupled through the beam couplers 100. Resulting in virtual lines being perpendicular to the mounting faces of the structural beam elements 50', 50" where the central plate 110 and the side plates 120 are mounted are now offset from each other, thus the depicted displacement of the central plate 110 and the front side plate 120 from each other.

On FIG. 2A, the central plate 110 and the side plates 120 are still attached to each other, defining a coupling assembly coupling the structural beam elements 50', 50" (i.e., a beam coupling assembly) under deflection without breakage while maintaining distance between the beam elements 50', 50" as will be explained hereinafter.

It is to be noted, as depicted on FIG. 2B, that upon deflection of the beam elements 50', 50", the two parts of the beam coupler 100 (the first part being the component mounted to the beam element 50' and the second part being the components mounted to the beam element 50") undergo a change in their angle $\theta$ and a relative displacement $\Delta$ in a longitudinal orientation (see axes on drawing page featuring FIGS. 6 and 7 for reference) directly depending on the angular deflection $\delta$ undergone by the beam elements 50', 50" at the location of mounting of the beam coupler 100 to the beam element 50', 50".

Figure 4:
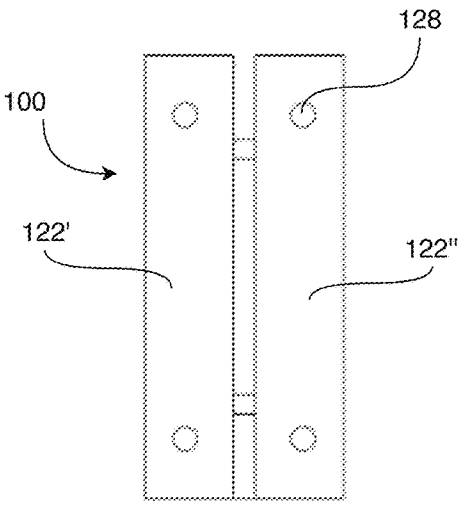
FIG. 4 is a side elevation view of the beam coupler of FIG. 3.
Figure 3:
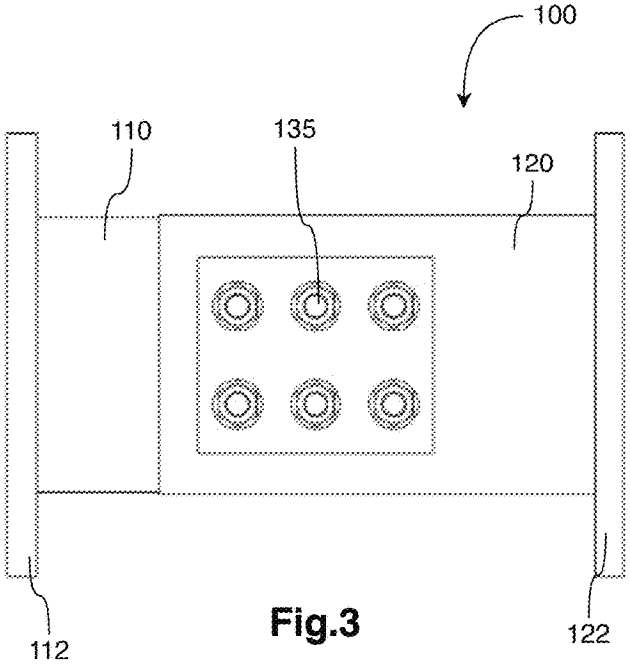
FIG. 3 is a side elevation view of a beam coupler in accordance with an embodiment.
Figure 5:
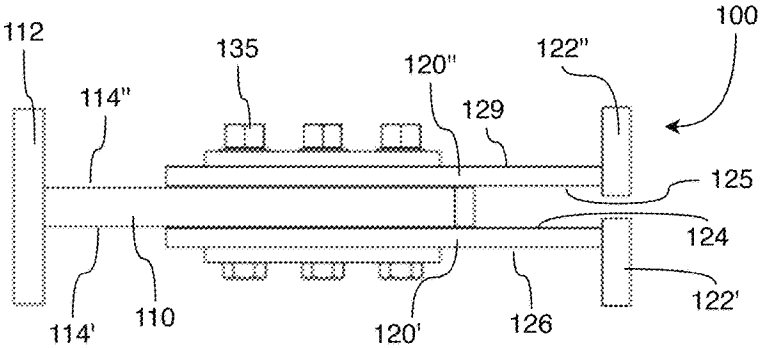
FIG. 5 is a top view of the beam coupler depicted on FIGS. 3 and 4.

Referring now to FIGS. 3 to 5, the beam coupler 100 comprises a central plate 110 and a pair of side plates 120. The central plate 110 is mounted to a first one of the beam elements 50', 50". The side plates 120 are mounted to the other one of the beam elements 50', 50". The plates are mounted to the beam elements 50', 50" using appropriate manner. According to the depicted realization, the plates 110, 120 comprise a mounting flange 112, 122 (the latter depicted as mounting flange 122' and mounting flange 122") which are mounted to the beam elements 50', 50" using, e.g., bolts and nuts.

According to alternative realizations, the mounting flanges 112, 122 are welded to the beam elements 50', 50", or mounted to the beam elements 50', 50" using other alternative solutions.

Referring particularly to FIG. 4, according to the depicted realization, the side plates 120 are mounted individually to the beam elements 50', 50".

According to a realization (not depicted), the side plates 120 comprise a common flange 122 itself mounted to the structural beam elements 50', 50", with the space between the side plates 120 being preset.

According to a realization, the side plates 120 each comprise an individual flange 122 featuring mounting holes 128, with either one of the flange 122 or the beam elements 50', 50" comprising transversally oblong mounting holes allowing to adjust the space between the side plates 120 when mounting the beam coupler 100 to the structural beam elements 50', 50".

Referring now particularly to FIG. 5, the central plate 110 comprises two side faces 114', 114" (aka central-plate side faces). The side plates 120 comprises an interior face 124 adapted to face and, according to the depicted realization, contact a side face 114', 114" of the central plate 110, and an exterior face 126 opposed to the interior face 124 according to the transversal orientation (see axes on drawing page featuring FIGS. 6 and 7 for reference).

The side plates 120 and the central plate 110 of the beam coupler 100 are mounted together using a plurality of compression means 135, e.g. bolts and nuts, with the compression means 135 comprising a body 137 (see FIG. 7) passing through the central plate 110 and the side plates 120 for the compression means 135 to compress the plates 110, 120 against each other, thereby applying a compression force, a.k.a. an inward preload, at the time of installation over the beam coupler 100.

It is to be noted that bolts and nuts are an exemplary method of mounting the central plate 110 and the side plates 120 together, with the side plates 120 pressing opposed faces of the central plate 110. Other solutions such as threaded rods and nuts may be used. The compression means 135 are adapted to apply a preset compression to the beam coupler 100 while passing through the central plate 110 and the side plates 120 for displacement limit as will be explained below.

Further, from the illustration, one must understand that the plates 110, 120 are mounted in a neighboring fashion, the central plate 110 neighboring the side plate 120' along the interface of the interior face 124 and the side face 114', the central plate 110 neighboring the side plate 120" along the interface of the interior face 125 and the side face 114", with the exterior face 126 of the side plate 120' and the exterior face 129 if the side plate 120" having no neighbor and thus defining exterior faces free of neighbors.

It is to ne noted that the plates are mounted alternatively in a neighboring fashion, namely the side plate 120' neighboring the central plate 110, and the central plate 110 neighboring the side plate 120". In other words, in an alternative fashion refers to neighboring plates being mounted to distinct beam elements 50' vs 50".

It is thus to be noted that the beam coupler will feature two exterior faces, with plates neighboring therebetween.

Figure 6:
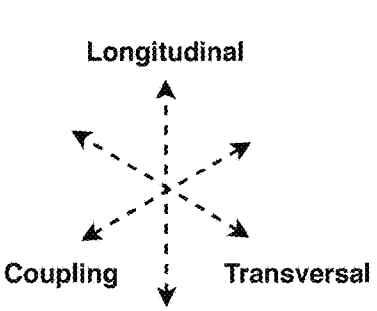
FIGS. 6 and 6A are perspective views of the beam coupler using a mounting side plate wherein, in accordance with an embodiment, the side plates feature circular holes, and wherein, and in accordance with another embodiment, the side plates features oblong holes.
Figure 6:
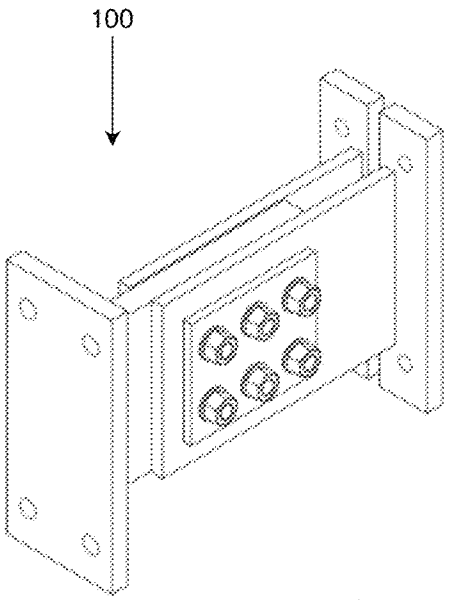
Figure 7:
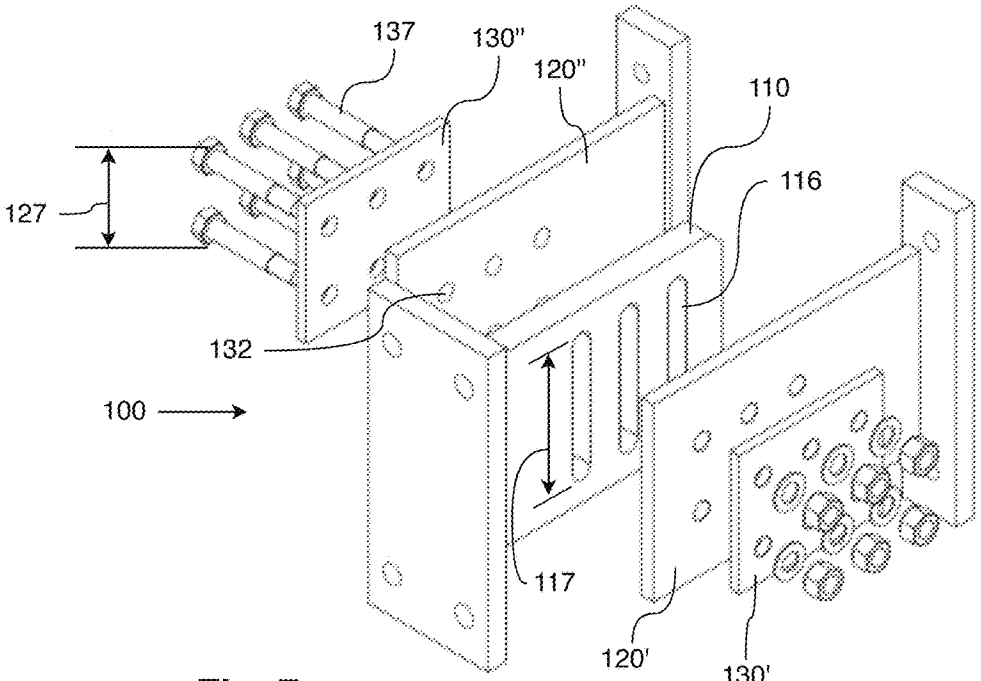
FIGS. 7 and 7A are perspective exploded views of respectively the beam coupler depicted on FIG. 6 and the beam coupler depicted on FIG. 6A.

Referring additionally to FIGS. 6 and 7, according to a realization, the beam coupler 100 comprises compression plates 130 (depicted as compression plates 130' and 130") external to the side plates 120' and 120", with the compression plates 130 being mounted to press against the external face of the side plates 120. The compression plates 130 providing means to equalize the compression force, a.k.a. preload, provided by the compression means 135 and to apply the sum of the compression forces over a greater surface of the side plates 120. The compression means 135 passes through, in order, a first compression plate 130', a first side plate 120', the central plate 110, the second side plate 120" and the second compression plate 130".

As shown with FIGS. 6 and 7, a longitudinal orientation is defined as the up-down orientation (i.e., in the orientation of the first beam and the second beam of the previous figures). A coupling orientation is defined as the orientation perpendicular to the orientation between the first beam and the second beam while being perpendicular to the longitudinal orientation. Finally, a transversal orientation is the orientation perpendicular to the longitudinal orientation and the coupling orientation, Referring now particularly to FIG. 7, the central plate 110 comprises oblong holes 116 according to the longitudinal direction of the beam elements 50', 50", aka longitudinal oblong holes 116. The oblong holes 116 provide passage to one or more compression means 135 (e.g., two (2) compression means 135 according to the depicted realization). The longitudinal oblong shape of the oblong holes 116 provides clearance for a potential course of the compression means 135 when displacements of the central plate 110 and the side plates 120 occur relative to each other, allowing longitudinal relative displacement/dis-alignment of the mounting sections of the structural beam elements 50', 50" wherein the beam coupler 100 is mounted without breakage.

In a preferred realization, oblong holes 116 are parallel to each other, thereby allowing displacement of the body 137 of the compression means 135 within the oblong holes 116 without generation of stress over the compression means 135.

According to the depicted realization, the central plate 110 feature three (3) longitudinal oblong holes 116, each allowing two (2) compression means 135 to pass therethrough. The longitudinal length 117 of the oblong holes 116 is greater than the extreme distance 127 defined by the distance between the opposed contact sides of compression means 135 designed to pass through the same oblong hole 116. Accordingly, oblong hole clearance remains, typically on both sides, in the longitudinal direction so that the compression means 135 may travel within the oblong holes 116 as the beam elements 50', 50" undergo deflection.

It is worth noting that determination of the number of oblong holes and the clearance provided by the oblong holes for displacements of the central plate 110 and the side plates 120 relative to each other is a question of requirements. For example, the number of oblong holes is determined by the amplitude of allowed displacement of the central plate 110 and the side plates 120 relative to each other, and by the required compression force, a.k.a. preload, to be applied to over the beam coupler 100 upon installation.

According to realizations (with some not depicted), the number of compression means 135 per oblong hole 116 is between one (1) and three (3).

According to realizations (with some not depicted), the number of oblong holes 116 is between one (1) and six (6). According to realizations, the number of oblong holes 116 is at least three (3).

Figure 6A:
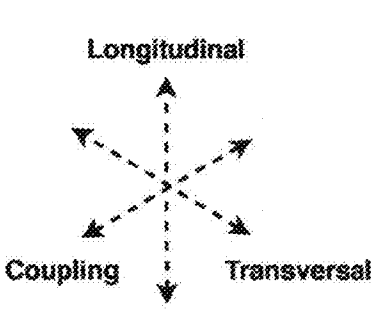
Figure 6A:
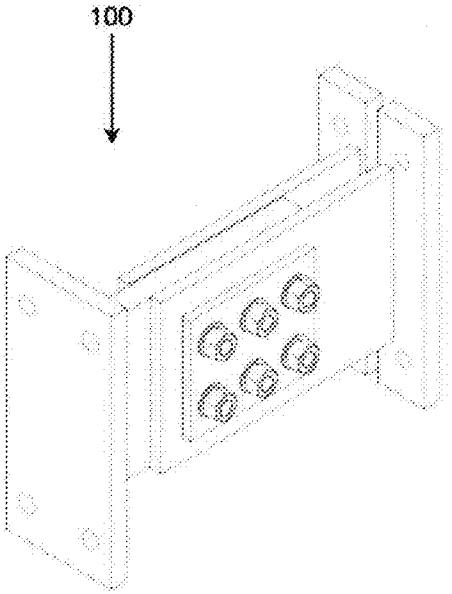
Figure 7A:
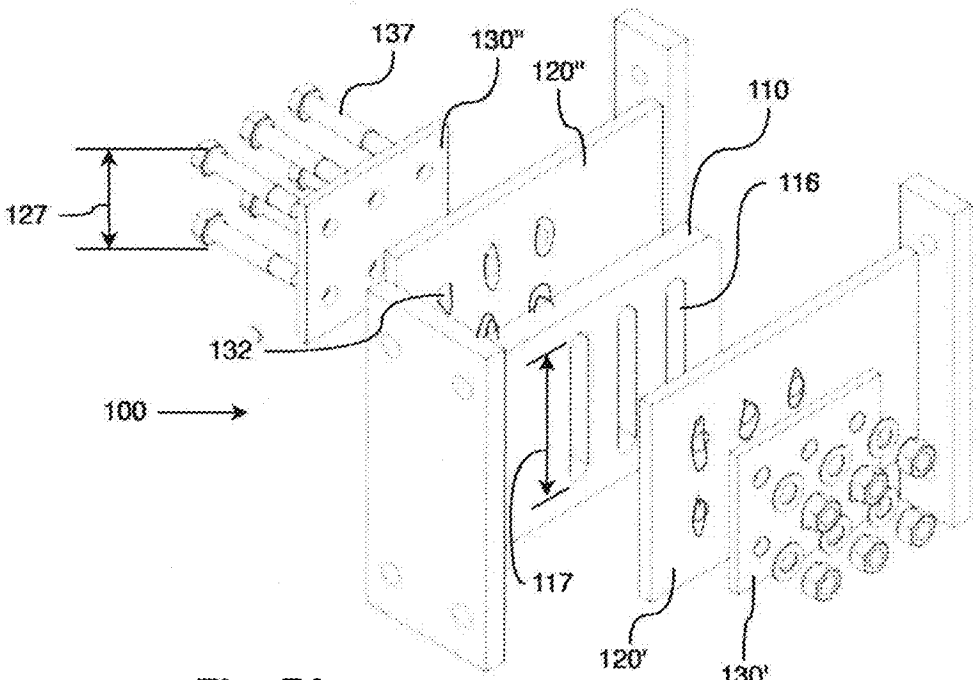

Referring to FIGS. 6A and 7A, according to a realization, at least one of the side plates 120 features longitudinal oblong hole(s) 132' (compared with e.g., oblong holes 116) whereby the compression means 135 passing through the central plate 110 and the side plates 120 may be displaced within the oblong hole(s) 132' upon occurrence of displacements of the central plate 110 and the side plates 120 relative to each other.

According to realizations, the central plate 110 features oblong holes 116 while the side plates 120 feature circular holes 132.

According to realizations as an example depicted on FIG. 7, the number of circular holes 132 per plate, e.g., side plate 120' with six (6) circular holes 132 depicted, is greater than the number of oblong holes 116 per neighboring plate, e.g. central plate 110 with three (3) oblong holes 116 depicted.

According to a realization (not depicted), both a) the central plate 110 and b) both ones of the side plates 120 feature longitudinal oblong hole(s).

According to a realization, regardless of which one of the central plate 110 and the side plates 120 comprise(s) oblong hole(s), the compression plates 130 features circular holes for the passage of the compression means 135 therethrough.

Figure 8:
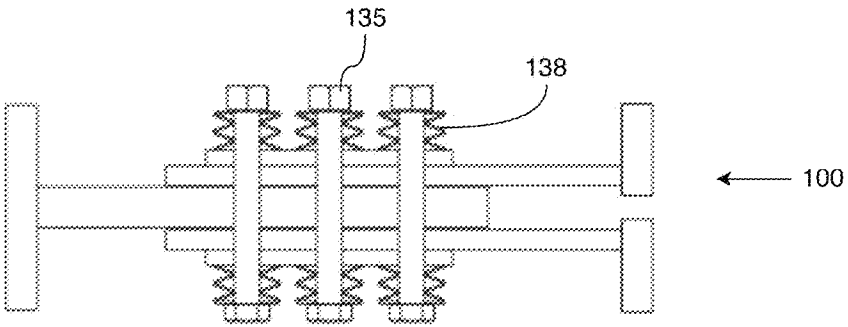
FIG. 8 is a top view of a beam coupler mounted with spring washers in accordance with an embodiment.

Referring now to FIG. 8, the compression means 135 comprises disk springs 138, or equivalent such as spring washers, for maintaining a pre-load in some conditions.

Figure 9:
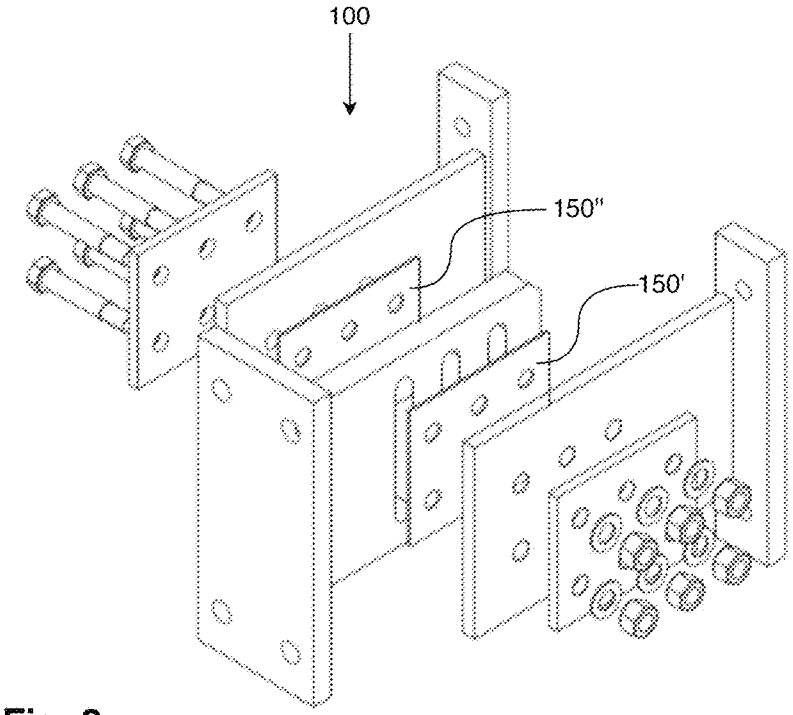
FIG. 9 is an exploded view of the beam coupler mounted with friction plates in accordance with an embodiment.

Referring to FIG. 9, a realization of the beam coupler 100 further comprises friction pads 150 (depicted as friction pads 150' and friction pads 150") inserted in the interfacing spaces located between the central plate 110 and the side plates 120 for improved operation as a seismic brake, energy dissipation device or seismic damage control device. Preferably, when used, the friction pads 150 are installed in each interfacing space at installation. The friction pads 150 are designed to provide a desired coefficient of friction against displacement relative to the central plate 110 and/or the side plates 120. The friction pads 150, acting similar to brake pads in the automotive industry, are adapted to transform kinetic energy resulting from force deflection of the beam elements 50', 50" from an earthquake, into thermal energy to be dissipated in the environment.

Figure 10:
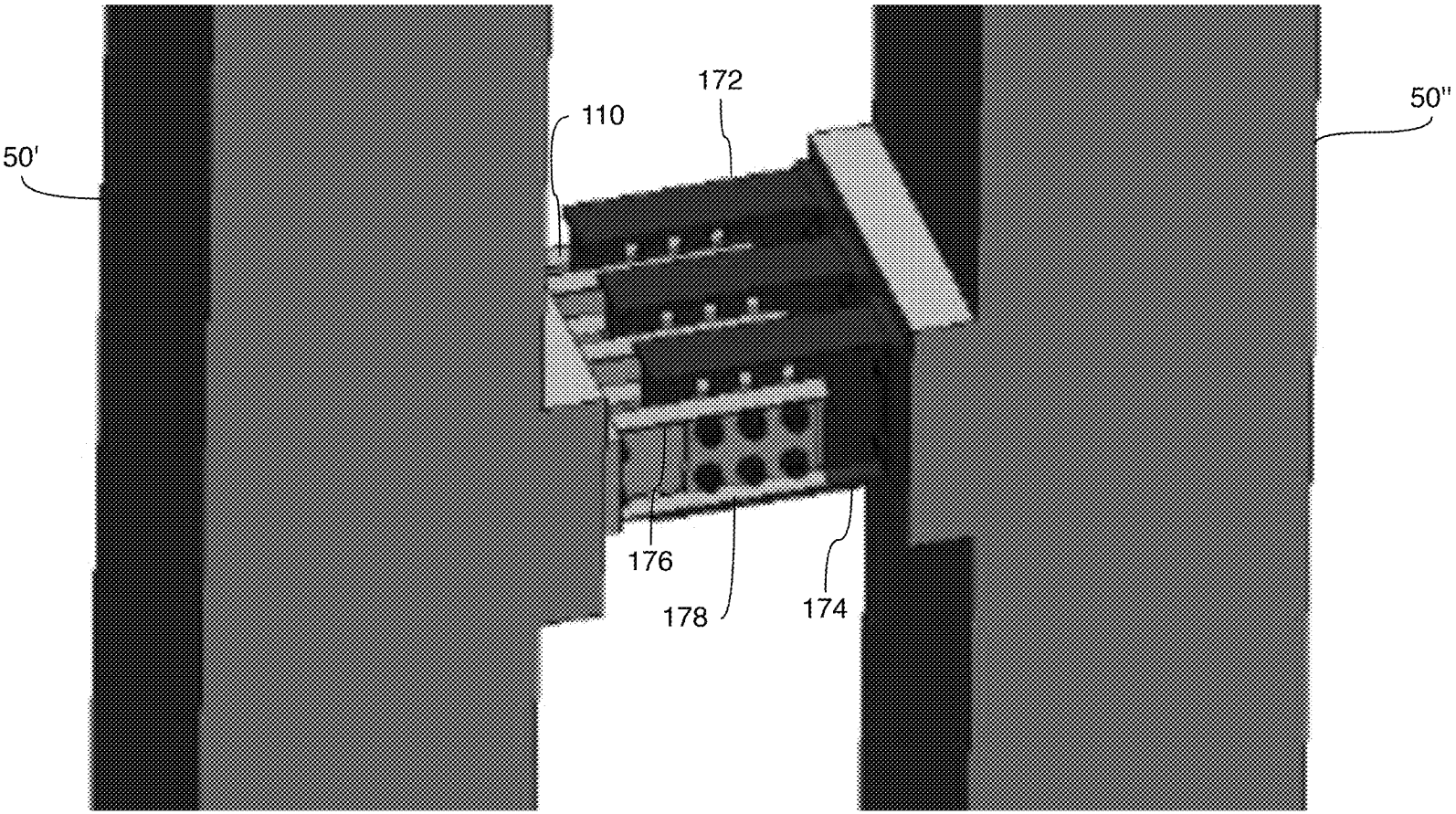
FIG. 10 is a perspective view of a pair of beam elements with a plurality of beam couplers mounted in parallel, in accordance with an embodiment.

Referring now to FIG. 10. According to realizations, the central plate 110 comprises double-sided gussets, a.k.a. flanges, namely a top gusset 172 and a bottom gusset 174 defining together with the central flat portion therebetween a I-shaped beam, wherein the flat portion of each of the side faces 114', 114" of the central plate 110 between the top gusset 172 and the bottom gusset 174 permits relative displacement of the side plates 120. According to that realization, the gussets 172, 174 act against torsion of the central plate 110 around a coupling axis (see axes on drawing page featuring FIGS. 6 and 7 for reference).

According to a realization, the gussets 172, 174 of the central plate 110 act as boundaries limiting displacement of the side plates 120 upon breakage of some of the compression means 135.

According to a realization, each one of the side plates 120 comprises a single-sided gusset, namely a top gusset 176 and a bottom gusset 178 defining together with the flat portion therebetween a C-shaped beam, extending sideway outward, with the interior face 124 of the side plate 120 contacting the central plate 110. According to that realization, the gussets 176, 178 act against torsion of the side plate 120 around a coupling axis (see axes on drawing page featuring FIGS. 6 and 7 for reference).

According to a realization, a plurality of beam couplers 100 can be installed side-by-side on beam elements 50', 50", aka in parallel, with the number of beam couplers 100 increasing control of the deflection of the beam elements 50', 50".

According to realizations (not depicted), the number of central plates 110 and of side plates 120 compressed together with compression means 135 is greater than one (1) and two (2), preferably with the number of side plates 120 being one more than the number of central plates 110, for instance two (2) central plates 110 and three (3) side plates 120. Accordingly, the sequence of contacting faces of plates are alternating, e.g., side plate 120|central plate 110; central plate 110|side plate 120; side plate 120|central plate 110 and central plate 110|side plate 120. Thus, according to a preferred realization, the sequence of contacts between plates starts and ends with a side plate 120, thus with one additional side plate 120 relative to the number of central plate 110.

Figure 11:
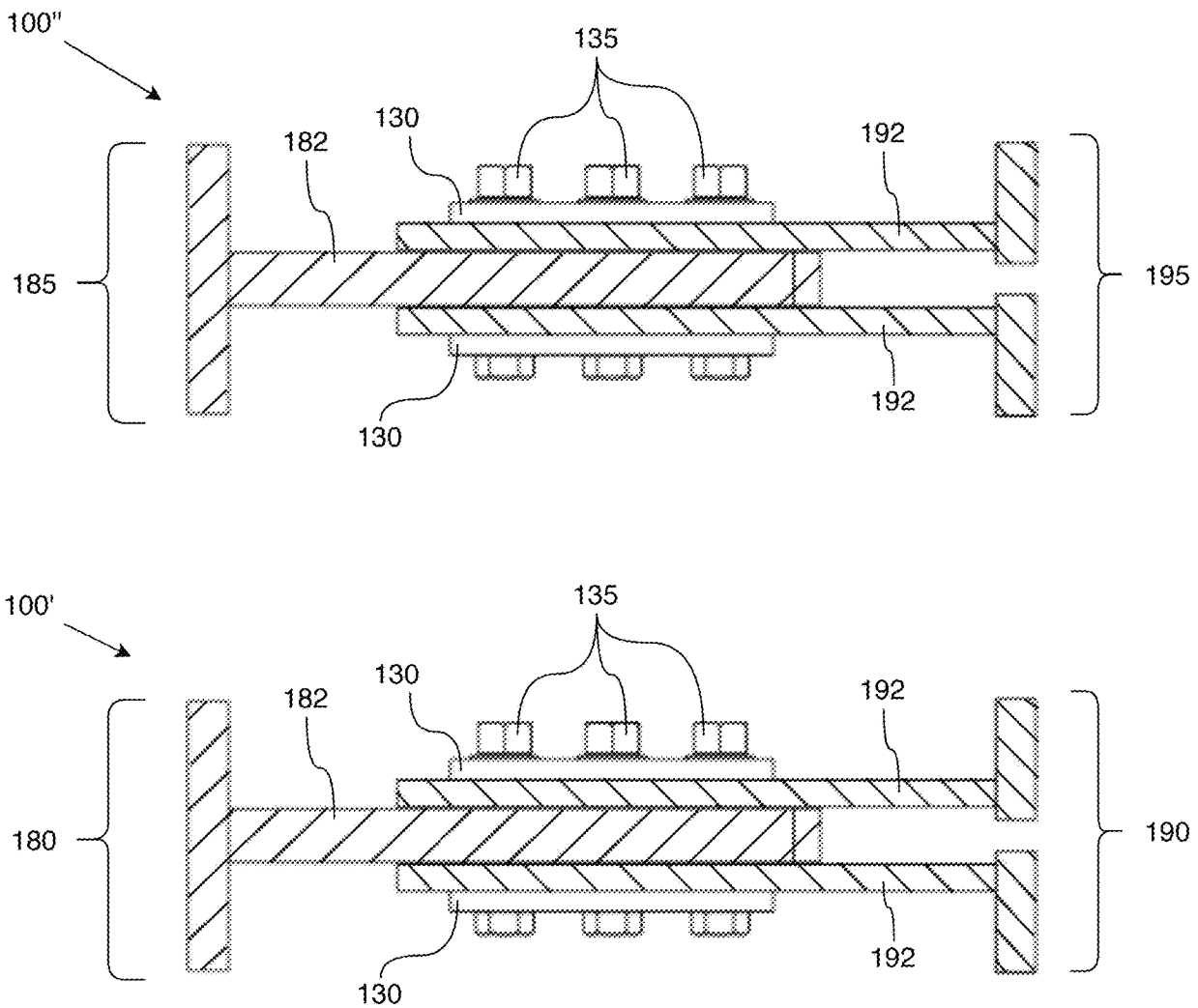
FIG. 11 is a top view of two beam couplers identical to the one depicted on FIG. 5 depicted offset from each other.

Referring now particularly to FIGS. 1 and 11, where FIG. 11 depicts beam couplers 100' and 100" according to a top view with the beam couplers 100', 100" offset from each other for better understanding. According to realizations, in the first beam coupler 100', the plate hereinbefore called central plate may be called a plate 182 of a first-plate set 180 (herein depicted with left-sloped lines), wherein the plate(s) 182 of the first-plate set 180 is(are) mounted to a first beam element 50' (see FIGS. 1A-1B). According to a realization, the number of plates 182 of the first-plate set 180 may be greater than one (1).

In the same line of thinking, still in the first beam coupler 100', the group of plates hereinbefore individually called side plates may be called a second-plate set 190, wherein the plates 192 (herein depicted with right-sloped lines) of the second-plate set 190 are mounted to a second beam element 50" (see FIGS. 1A-1B). According to a realization, the number of plates 192 of the second-plate set 190 may be a minimum of one (1) and, according to the number of plates 182 in the first-plate set 180, said number of plates 192 in the second-plate set 190 may range between the number of plates 182 of the first-plate set 180 minus one (1) and the number of plates 182 of the first-plate set 180 plus one (1).

In the first beam coupler 100', the plates 182, 192 of the first-plate set 180 and of the second-plate set 190 are mounted together to allow relative longitudinal displacement therebetween.

In the second beam coupler 100", plate(s) 182 of a third-plate set 185 (herein depicted with left-sloped lines) is(are) mounted to the first beam element 50' (see FIGS. 1A-1B). As with the first-plate set 180, the number of plates 182 of the third-plate set 185 may be greater than one (1).

Still in the second beam coupler 100", plate(s) 192 of a fourth-plate set 195 (herein depicted with right-sloped lines) are(is) mounted to the second beam element 50" (see FIGS. 1A-1B). As with the first-plate set 180, the number of plates 192 of the fourth-plate set 195 may be a minimum of one (1) and, according to the number of first-beam plates 182 in the third-plate set 185, said number of plates 192 in the fourth-plate set 195 may range between the number of plates 182 of the third-plate set 185 minus one (1) and the number of plates 182 of the third-plate set 185 plus one (1).

In the second beam coupler 100", the plates 182, 192 of the third-plate set 185 and of the fourth-plate set 195 are mounted together to allow relative longitudinal displacement therebetween.

According to a realization wherein the total number of plates (plates 182 and plates 192) in the, e.g., sets 180 and 190 of a, e.g. beam coupler 100', is even, it is a preferred realization to use compression plates 130 to help maintain alignment of the compression means 135.

According to a realization, the plates, namely the central plate(s) 110 and the side plates 120, aka plates 182, 192, are made of metallic material.

According to a realization, the compression plates 130 are made of metallic material.

According to a realization, the compression means 135 are made of metallic material.

According to a realization, the friction pads 150 are made of one of metallic material, non-metallic material, and/or coated with a friction-controlling material to obtain the desired characteristics, comprising a desired coefficient of friction.

According to a realization, at least one of the side faces 114', 114" of the central plate 110, aka plate 182, and the interior faces 124 of the side plates 120, aka plate(s) 192, are coated with a friction-controlling material in order for the displacement of the plates 110, 120 relative to each other to occur according to a desired coefficient of friction therebetween.

Now referring to FIGS. 12 to 15, another embodiment of a beam coupler 200 is adapted to extend in a coupling orientation connecting the first beam element 50' to the second beam element 50" that is non-perpendicular to the beam elements 50', 50" to which the beam coupler 200 is mounted.

The beam coupler 200, according to an embodiment, comprises a central plate 210, two side plates 220', 220" each having an interior face 224', 224" interfacing with a side 214'/214" of the central plate 210, two compression plates 230', 230" interfacing with the exterior face 226 of the side plates 220', 220", and compression means 235 adapted to exert inward force to the ordered combination of a first compression plate 230', a first side plate 220', the central plate 210, the second side plate 220", and the second compression plate 230".

The central plate 210 comprises an oblong hole 216 in the coupling orientation. Thus, the oblong hole 216 is non-parallel to (i.e., angled relative to or at a non-zero angle relative to) the longitudinal orientation of the beam elements 50' and 50" to which the beam coupler 200 is mounted. The oblong hole 216 provides passage to the compression means 235. The shape of the oblong hole 216 allows displacement of the compression means 235 upon displacement of the central plate 210 relative to the side plates 220', 220" in the coupling orientation.

According to an embodiment, the angle of the oblong hole 216 relative to the longitudinal orientation of the beam elements 50' and 50" is between 20 degrees and 80 degrees. According to an embodiment, the angle of the oblong hole 216 relative to the longitudinal orientation of the beam elements 50' and 50" is between 30 degrees and 75 degrees. According to an embodiment, the angle of the oblong hole 216 relative to the longitudinal orientation of the beam elements 50' and 50" is between 40 degrees and 70 degrees. According to an embodiment, the angle of the oblong hole 216 relative to the longitudinal orientation of the beam elements 50' and 50" is between 50 degrees and 65 degrees.

Figure 12:
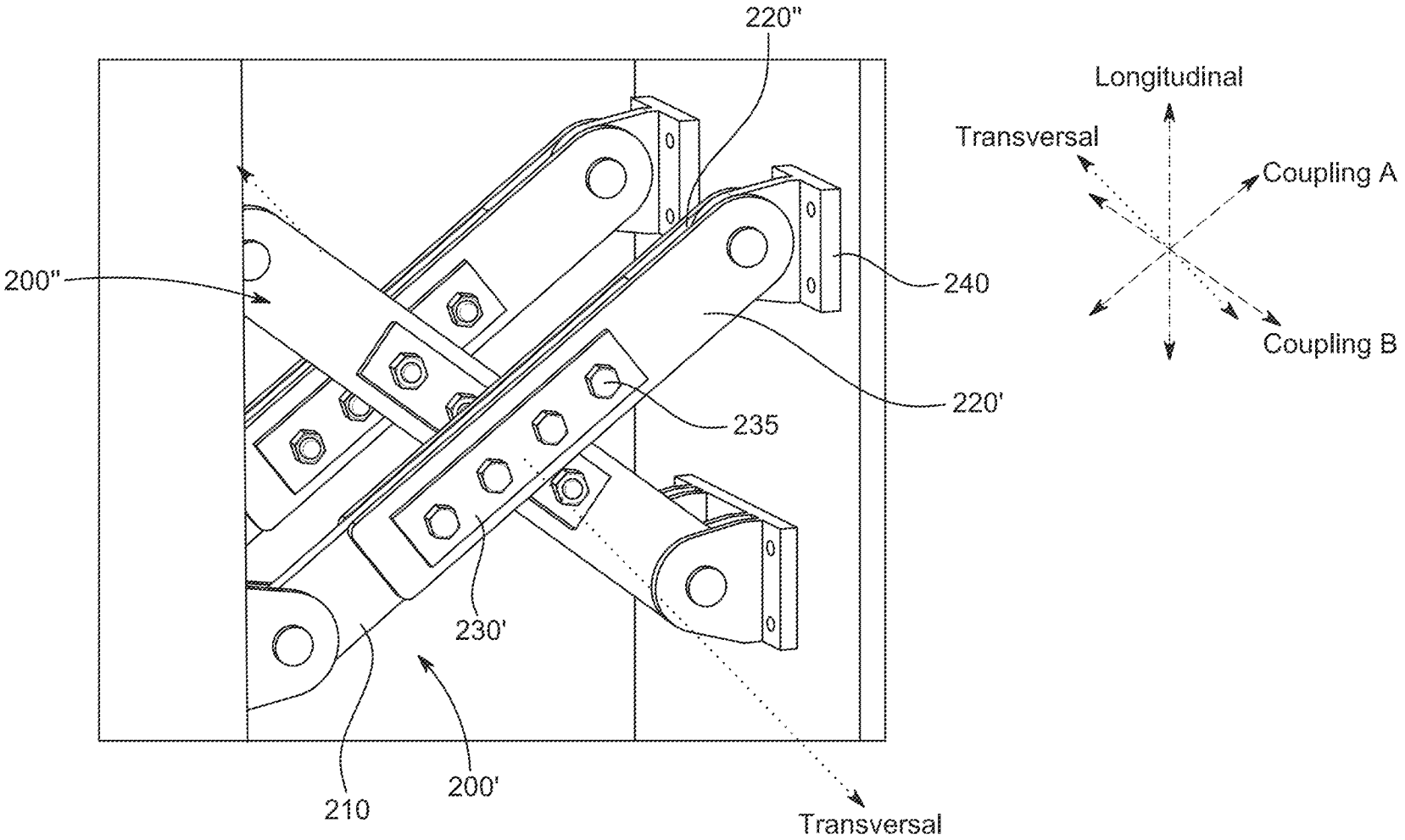
FIG. 12 is a perspective view of beam couplers mounted to parallel beams in accordance with another embodiment.
Figure 13:
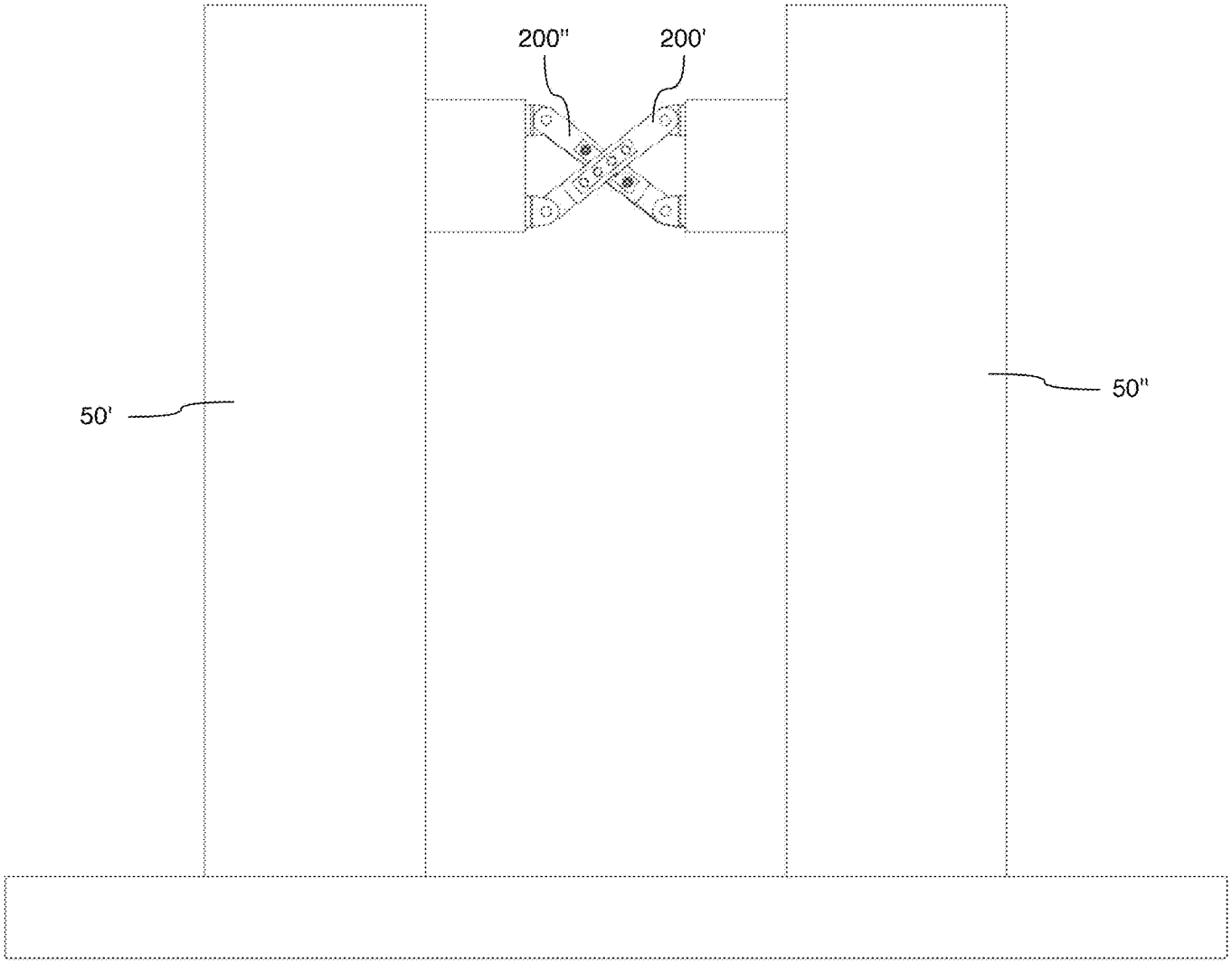
FIG. 13 is a front view of the beam couplers of FIG. 12.
Figure 14:
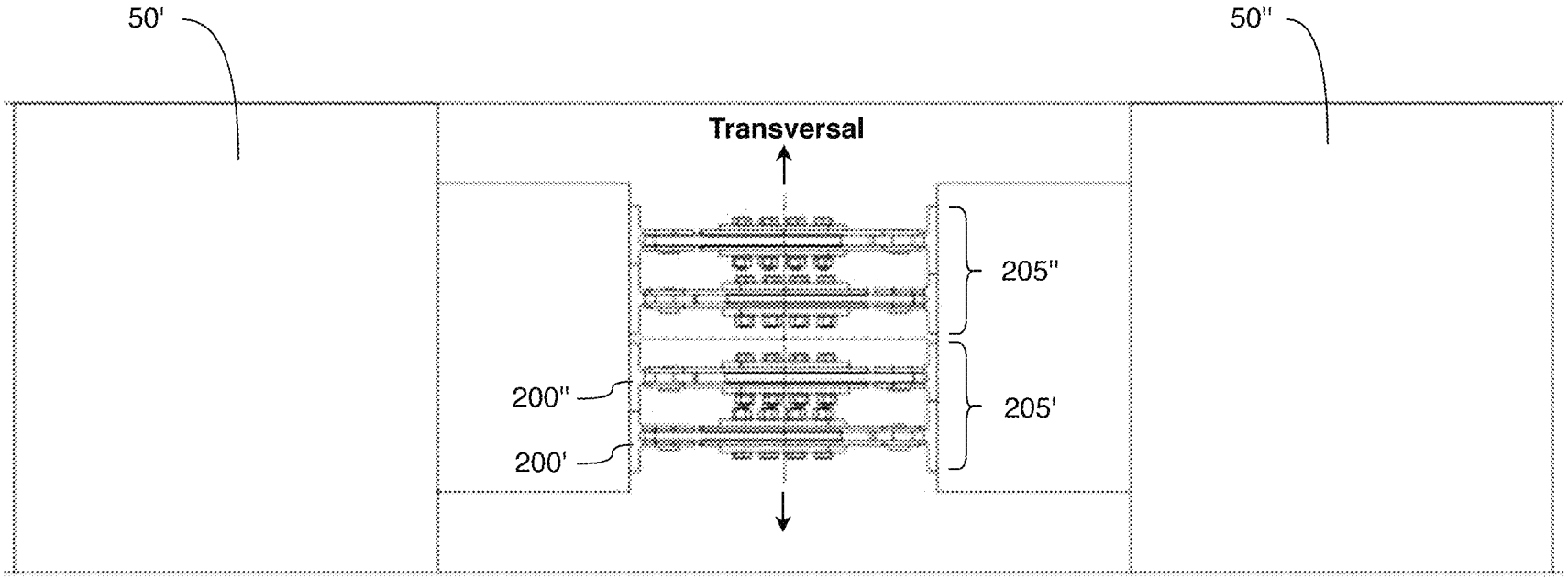
FIG. 14 is a top view of the beam couplers of FIG. 12.

According to a preferred realization depicted on FIGS. 12 to 14, a beam coupling assembly 205 comprises at least a first beam coupler 200' and a second beam coupler 200" extending according to a general coupling orientation perpendicular to the longitudinal orientation (see coupling orientation on drawing page featuring FIGS. 6 and 7 for reference) comprising distinct non-parallel coupling orientations (see axes of coupling orientation A, aka coupling A axis, and coupling orientation B, aka coupling axis B, on drawing page featuring FIG. 12 for reference). The oblong hole 216 (see FIG. 16) of the first beam coupler 200' and the oblong hole of the second coupler 200" are thereby oriented non-parallel to each other, providing counteraction against each other in case of deflection of the beam elements 50' and 50".

Still referring to FIGS. 12 to 14, two beam coupling assemblies 205' and 205" are mounted side-by side along the transversal orientation (see axis on drawing page featuring FIG. 12 for reference, on FIG. 12 and on FIG. 14). The two coupling assemblies 205' and 205" allows to distribute the forces undergone upon deflection of the beam elements 50' and 50".

Still referring to FIGS. 12 to 14 and additionally to FIG. 1, two or more beam couplers 200 (not shown together but the beam couplers being mounted to beam elements 50' and 50" in a configuration equivalent to the beam couplers 100' and 100" on FIG. 1) are adapted to be mounted in series, whereby the first one of the beam couplers 200 is adapted to be mounted to the beam elements 50' and 50" at a first longitudinal distance greater than zero (0), e.g., three (3) meters, from the second one of the beam couplers 200.

According to a realization, two or more beam coupling assemblies 205', 205" (not shown together but the beam coupling assemblies being mounted to beam elements 50' and 50" in a configuration equivalent to the beam couplers 100' and 100" on FIG. 1) are adapted to be mounted in series, whereby the first one of the beam coupling assemblies 205', 205" is adapted to be mounted to the beam elements 50' and 50" at a first longitudinal distance greater than zero (0), e.g. three (3) meters, from the second one of the beam coupling assemblies 205', 205".

Figure 16:
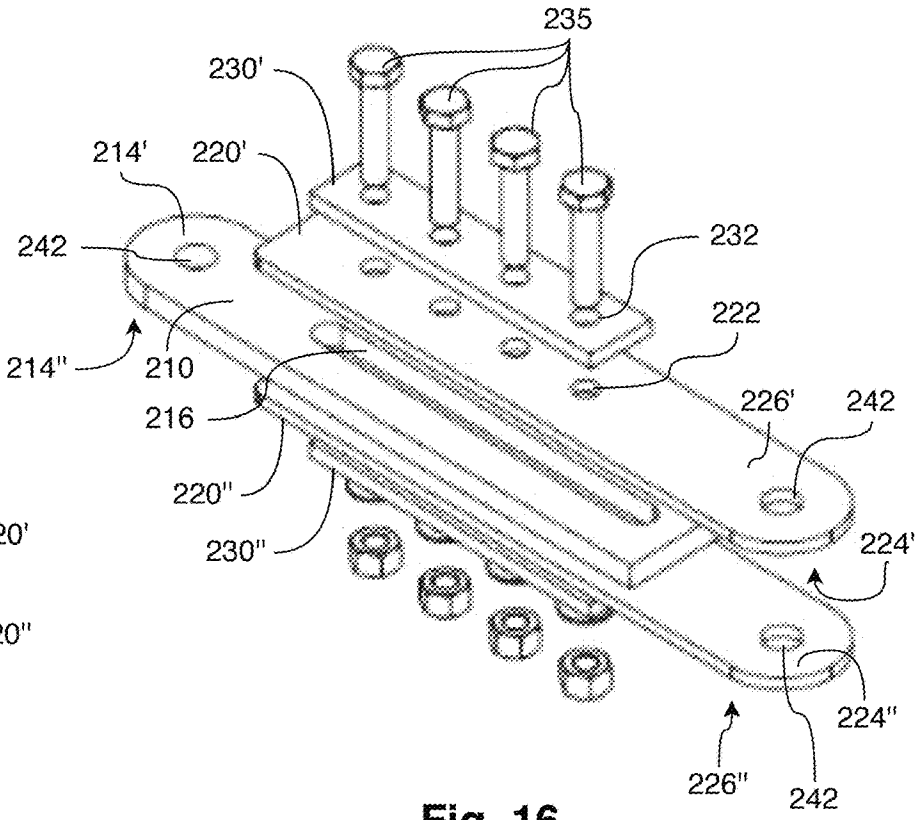
FIG. 16 is an exploded view of the components depicted on FIG. 14.
Figure 15:
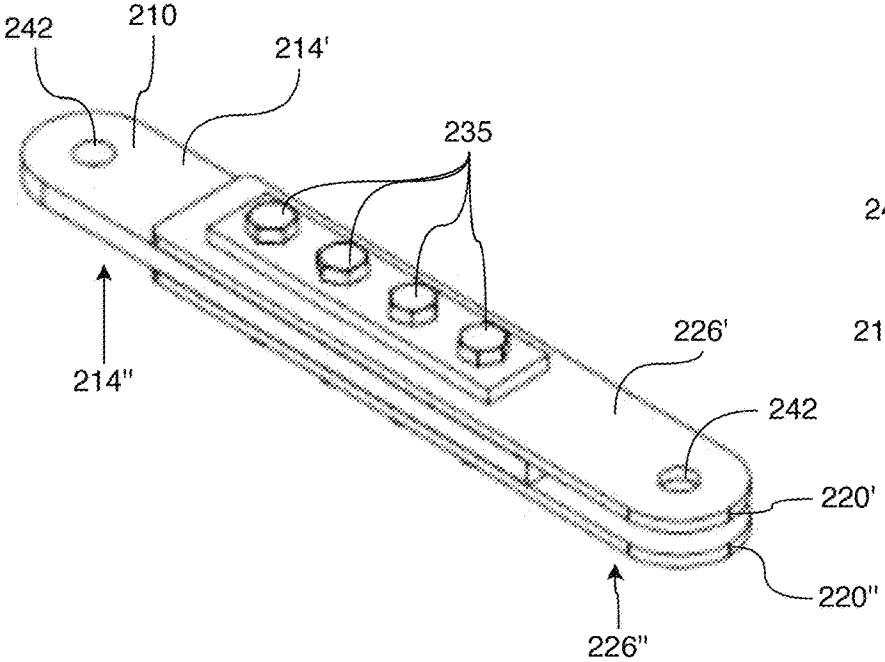
FIG. 15 is a perspective view of assembled components of a beam coupler in accordance with the embodiment depicted on FIGS. 12 to 14.

Referring now to FIGS. 12 to 14 and additionally to FIGS. 15 and 16, the beam coupler 200 comprises a central plate 210 featuring an oblong hole 216, two side plates 220', 220" featuring circular holes 222, two compression plates 230', 230" featuring circular holes 232 and compression means 235. The compression means 235 are mounted to pass through the holes 216, 222, and 232 to push inwardly, thus applying an inward preload, over the compression plates 230 while being allowed displacement in the oblong hole 216.

The central plate 210 and the side plates 220', 220" of the beam coupler 200 further comprises a plate-mounting hole 242 for mounting the plates 210, 220', 220" to mounting flanges 240.

According to a realization, the plates 210, 220', 220" are mounted pivotally to the mounting flanges 240.

Figure 17:
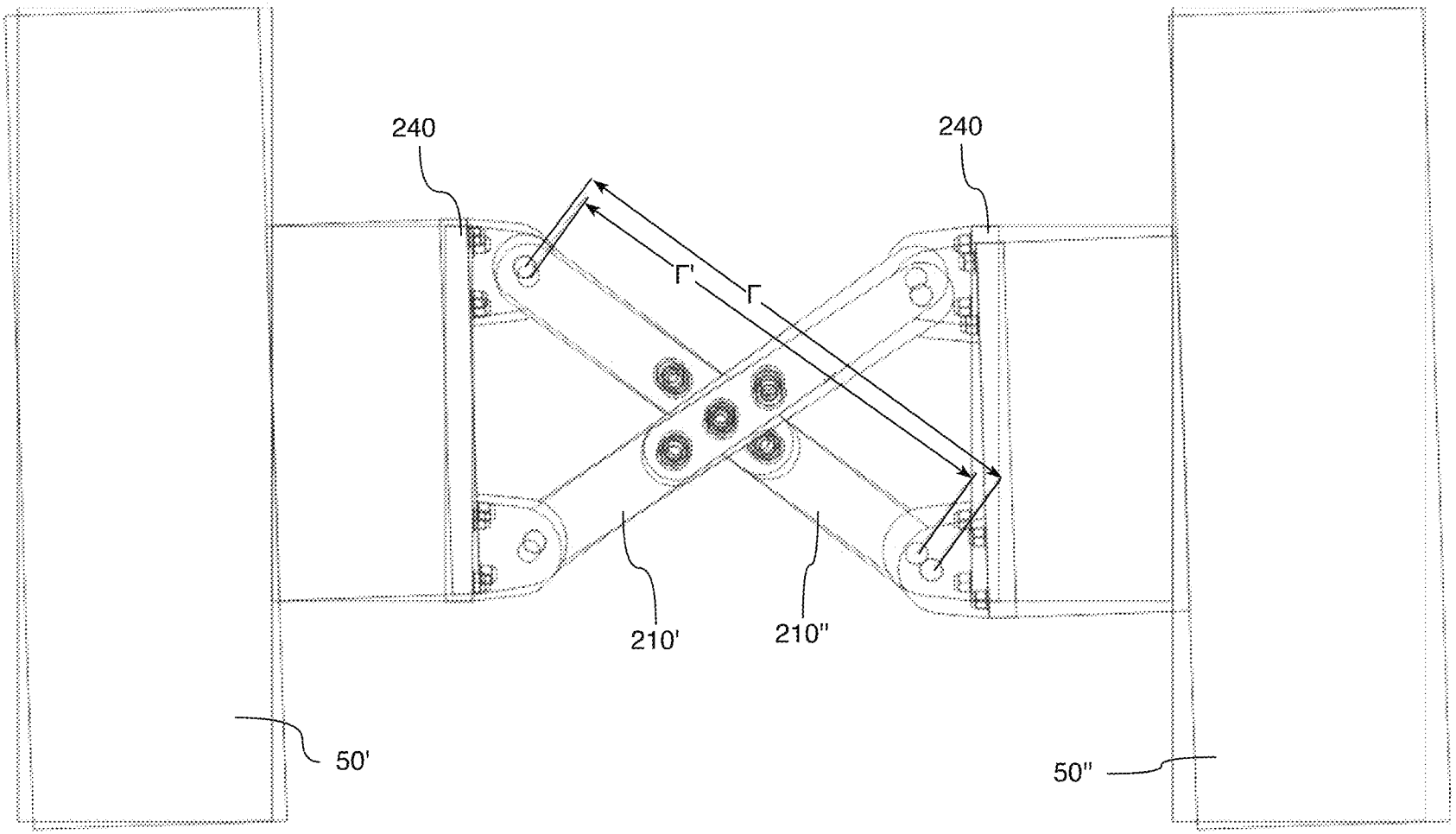
FIG. 17 is a schematic depicting reactions in the beam couplers of FIGS. 12 to 14 while installed between the beam elements undergoing no deflection and the beam elements undergoing deflection.

Referring now to FIG. 17, upon deflection of, for example, the beam elements 50' with the beam element 50" following said deflection, the oblong holes 216 of the first beam coupler 200' and of the second coupler 200", oriented in a non-parallel manner to each other, counteract against each other; components of the displacement of the compression means 235 in the oblong holes 216 resulting from the beam element 50' deflecting toward or away from the beam element 50" would result in opposed longitudinal components of the displacement of the compression means 235 in the oblong holes 216.

FIG. 17 depicts changes in the length of the second beam coupler 200" resulting from deflection of the first beam element 50' while the beam couplers 200' and 200" are maintaining parallelism between the first beam element 50' and the second beam element 50". For example, the beam coupler 200" featuring no deflection has a length Γ. Under deflection, the beam coupler 200" extends to length Γ'. This change in the length of the beam coupler 200" allows changes in the position of the mounting flanges 240 following the deflection of the beam elements 50' and 50" while maintaining the parallelism between the beam elements 50' and 50".

It is worth noting that alternative realizations described in relation with the beam coupler 100 are also available with the beam coupler 200.

More precisely, the beam coupler 200 may feature variations in the number of plates, the number of oblong holes, the nature of the plates featuring oblong holes, whether or not using compression plates, whether or not having plates featuring gussets, whether or not having the compression means comprising disk springs, whether or not coupling means comprising friction pads, and whether or not using plates coated with a friction-controlling material to list some. All combinations of these variations are also intended to be contemplated through the present statement.

Therefore, the beam coupler 200 is thereby contemplated to be able to encompass many variations similar to the ones described in relation with the beam coupler 100.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A beam coupling comprising:

a first beam element and a second beam element mounted side by side, the first beam element and the second beam element extending both in a first orientation parallel to each other with the first beam element and the second beam element having respectively a facing surface parallel to and facing each other;

a plurality of beam couplers mounted to the first beam element and to the second beam element for coupling the first beam element and the second beam element, the plurality of beam couplers extending in a second orientation coupling the first beam to the second beam, the beam couplers extending parallel to each other, at least one of the beam couplers comprising:

a central plate mounted to the facing surface of the first beam element, the central plate comprising:

two central-plate side faces; and a central-plate hole providing a passage connecting the two central-plate side faces;

a pair of side plates mounted to the facing surface of the second beam element, each one of the side plates comprising:

an interior face neighboring one of the two central-plate side faces;

an exterior face; and a side-plate hole providing a passage connecting the interior face with the exterior face; and compression means applying an inward preload over the central plate and the side plates, the compression means comprising:

a body extending through the central-plate hole and the side-plate holes, wherein the central-plate hole has an oblong shape, thereby defining an oblong hole that has a width and a length greater than width, wherein the length extends in the first orientation, and wherein the oblong hole allows displacement of the body of the compression means therein in the first orientation upon displacement of the central plate and the side plates relative to each other resulting from a deflection of the beam elements, wherein the beam couplers maintain a constant distance between the beam elements upon the deflection of the beam elements.

2. The beam coupling of claim 1, wherein at least one of a) the central-plate hole and b) the side-plate hole has a circular shape.

3. The beam coupling of claim 1, wherein a first number of circular holes are present per plate, a second number of oblong holes are present per plate, and wherein the first number is greater than the second number.

4. The beam coupling of claim 1, wherein a number of oblong holes is present per plate that is at least two (2), and wherein the oblong holes are parallel to each other.

5. The beam coupling of claim 1, wherein the compression means comprises disk springs.

6. The beam coupling of claim 1, further comprising friction pads.

7. The beam coupling of claim 1, further comprising compression plates to be mounted exterior to the exterior face of each of the side plates.

8. The beam coupling of claim 1, wherein the central plate and the side plates each comprise a mounting flange to be mounted to the beam elements.

9. The beam coupler of claim 1, wherein one of the central plate and the side plates comprises a gusset.

10. A beam coupling comprising:

a first beam element and a second beam element extending parallel to each other in a first orientation, with the first beam element and the second beam element having a facing surface parallel to and facing each other;

a plurality of beam couplers coupling the first beam element to the second beam element, the plurality of beam couplers extending parallel to each other in a second orientation, at least one of the plurality of beam couplers comprising:

a plurality of plates mounted alternatively to the facing surface of the first beam element and to the facing surface of the second beam element, the plurality of plates neighboring one another, wherein at least a first one of the plates comprises oblong holes that have a width and a length greater than the width, wherein the length extends in the first direction; and a plurality of compression means each comprising a body that extends in one of the oblong holes, with the compression means applying an inward preload over the plates, wherein the oblong holes allow displacement of the body of the compression means therein in the first orientation upon displacement of the plates relative to each other resulting from a deflection of the first beam element and the second beam element while maintaining a constant distance between beam elements where coupled through the beam couplers.

11. The beam coupling of claim 10, wherein a second one of the plates comprises circular holes.

12. The beam coupling of claim 11, wherein a first number of oblong holes are present on the first plate, a second number of circular holes are present on the second plate, and wherein the second number is greater than the first number.

13. The beam coupling of claim 10, wherein a number of oblong holes is present on the first plate that is at least two (2), and wherein the oblong holes are parallel to each other.

14. The beam coupling of claim 10, wherein the plates comprises an interior face that face each other and an exterior face opposed to the interior face, the beam coupler further comprising compression plates to be mounted exterior to the exterior face of the plates.

15. The beam coupling of claim 10, wherein the plates each comprise a mounting flange to be mounted to the facing surfaces of the beam elements.

16. The beam coupler of claim 10, wherein at least one of the plates comprises a gusset.

17. The beam coupling of claim 10, wherein the plates comprises an interior face that face each other, the beam coupler further comprising a friction pad to be mounted between the interior faces.

18. The beam coupling of claim 1, wherein the beam couplers are rigidly mounted to the beam elements.

19. The beam coupler of claim 10, wherein the beam couplers are rigidly mounted to the beam elements.

20. A beam coupling comprising:

a first beam element and a second beam element extending parallel to each other in a first orientation, with the first beam element and the second beam element having a facing surface parallel to and facing each other;

a beam coupler extending in a second orientation, the beam coupler coupling the first beam element to the second beam element, the beam coupler comprising:

a plurality of plates mounted alternatively to the facing surface of the first beam element and to the facing surface of the second beam element, the plurality of plates neighboring one another, wherein one of the plates comprises oblong holes that have a width and a length greater than the width, wherein the length extends in the first direction; and a plurality of compression means each comprising a body that extends in one of the oblong holes, with the compression means applying an inward preload over the plates, wherein the oblong holes allow displacement of the body of the compression means therein in the first orientation upon displacement of the plates relative to each other resulting from a deflection of the first beam element and the second beam element while maintaining a constant distance between the beam elements where coupled through the beam coupler.

* * * * *